US007644878B2

(12) United States Patent
Mochizuki et al.

(10) Patent No.: US 7,644,878 B2
(45) **Date of Patent: *Jan. 12, 2010**

(54) INJECTOR

(75) Inventors: Kouichi Mochizuki, Anjo (JP); Masao Sawamura, Okazaki (JP)

(73) Assignee: Denso Corporation, Kariya (JP)

( * ) Notice: Subject to any disclaimer, the term of this patent is extended or adjusted under 35 U.S.C. 154(b) by 21 days.

This patent is subject to a terminal disclaimer.

(21) Appl. No.: 12/068,594

(22) Filed: Feb. 8, 2008

(65) Prior Publication Data

US 2008/0217429 A1 Sep. 11, 2008

(30) Foreign Application Priority Data

Mar. 5, 2007 (JP) ..... 2007-053738

(51) Int. Cl.
*F02M 61/20* (2006.01)

(52) U.S. Cl. ..... 239/533.9; 239/88; 239/102.2; 239/584; 251/129.06; 123/498

(58) Field of Classification Search ..... 239/88, 239/91, 96, 102.1, 102.2, 533.9, 533.12, 239/584; 123/498; 251/129.06
See application file for complete search history.

(56) References Cited

U.S. PATENT DOCUMENTS 4,635,849 A * 1/1987 Igashira et al. ..... 239/102.2
6,499,471 B2 * 12/2002 Shen et al. ..... 123/498
6,676,035 B2 * 1/2004 Lorraine et al. ..... 239/102.2
6,766,965 B2 * 7/2004 D'Arrigo ..... 239/102.2

FOREIGN PATENT DOCUMENTS

WO 2005/075811 8/2005

* cited by examiner

*Primary Examiner*—Steven J Ganey
(74) *Attorney, Agent, or Firm*—Nixon & Vanderhye, PC

(57) ABSTRACT

An injector includes a nozzle hole, a needle, an actuator, a piston that is displaced in an axial direction according to extension or contraction of the actuator, an outer sleeve holding the piston slidably on its outer circumferential side and defining a pressure chamber expanded or shrunk according to displacement of the piston. When fuel pressure in the pressure chamber is increased upon extension of the actuator, the needle opens the nozzle hole. The injector further includes an inner sleeve slidably fitted around the needle and received in the pressure chamber, an urging device for urging the inner sleeve in the axial direction and for increasing or decreasing its urging force according to displacement of the piston, an engagement surface, and a fuel chamber. A gap between the fuel chamber and the pressure chamber is closed or opened when the inner sleeve annularly engages or disengages from the surface, respectively.

3 Claims, 3 Drawing Sheets

INJECTOR

CROSS REFERENCE TO RELATED APPLICATION

This application is based on and incorporates herein by reference Japanese Patent Application No. 2007-53738 filed on Mar. 5, 2007.

BACKGROUND OF THE INVENTION

1. Field of the Invention

The present invention relates to an injector, which injects and supplies fuel into an engine.

2. Description of Related Art

In an injector that drives a needle to lift off to open a nozzle hole, it is conventionally considered increasing driving force needed to open the nozzle hole in order to improve injection responsivity. For example, an actuator of the injector includes an element that generates extending force, such as a piezoelectric element or a magnetostrictor, as a means for increasing the driving force.

As shown in FIG. 3, a conventional injector 100, which uses the extending force, includes a needle 102, a piezoelectric actuator 103, a piston 104, and an outer sleeve 106, as described, for example, in WO2005/075811A1. The needle 102 opens or closes a nozzle hole 101. The piezoelectric actuator 103 includes the piezoelectric element and extends or contract in an axial direction of the injector 100. The piston 104 is displaced in the axial direction according to the extension or contraction of the piezoelectric actuator 103. The outer sleeve 106 slidably holds the piston 104 on its outer circumferential side, and defines a pressure chamber 105 of fuel, which is expanded or contracted according to the displacement of the piston 104.

The needle 102 is incorporated into the injector 100 such that fuel pressure in the pressure chamber 105 is applied to the needle 102 in a valve opening direction. More specifically, the needle 102 is incorporated to define the pressure chamber 105 such that the fuel pressure is applied to a front end surface 108 of a rear end portion 107 in a direction toward a rear end side.

The injector 100 leads high-pressure fuel, which is received from a fuel supply source such as a common rail, into a nozzle chamber 109. The injector 100 increases the fuel pressure in the pressure chamber 105 by the extension of the piezoelectric actuator 103. As a result, the needle 102 is driven to lift off in the valve opening direction and to open the nozzle hole 101, so that fuel in the nozzle chamber 109 is injected.

According to the injector 100, fuel in the pressure chamber 105 leaks from sliding portions due to the increase in its pressure. An amount of fuel decreased due to the leak is replenished when the outer sleeve 106 disengages from a front end side body 110.

The outer sleeve 106 supports a spring 111 in the axial direction between the outer sleeve 106 and the piston 104. The pressure chamber 105 is formed when the outer sleeve 106 is urged toward the front end side by the spring 111 to engage the front end side body 110. An outer circumferential side of the outer sleeve 106 is filled with high-pressure fuel received from the fuel supply source. Urging force of the spring 111 applied to the outer sleeve 106 is increased or decreased according to the displacement of the piston 104 in the axial direction. Accordingly, when the urging force of the spring 111 is decreased, the outer sleeve 106 disengages from the front end side body 110, and thereby high-pressure fuel is replenished into the pressure chamber 105 from the outer circumferential side of the outer sleeve 106.

According to the conventional injector 100, a gap between the pressure chamber 105 and the outer circumferential side of the outer sleeve 106 is closed or opened when the outer sleeve 106 engages or disengages from the front end side body 110. Accordingly, the outer sleeve 106 engages the front end side body 110 annularly at a position located far part from the shaft center toward the outer circumferential side of the injector 100, so that an engagement diameter of the outer sleeve 106 is made large. Thus, liquid-tightness of the pressure chamber 105 is difficult to ensure at an engagement position of the outer sleeve 106 with the front end side body 110, so that the spring 111, the urging force of which is strong, needs to be selectively used.

SUMMARY OF THE INVENTION

The present invention addresses the above disadvantages. Thus, it is an objective of the present invention to make it easy to ensure liquid-tightness of a pressure chamber in an injector, which drives a needle to lift off upon extension of an actuator to inject fuel.

To achieve the objective of the present invention, there is provided an injector for injecting high-pressure fuel supplied by a fuel supply source. The injector includes a nozzle hole, a needle, an actuator, a piston, an outer sleeve, an inner sleeve, an urging means, an engagement surface, and a fuel chamber. High-pressure fuel is injected through the nozzle hole. The needle opens or closes the nozzle hole. The actuator extends or contracts in an axial direction of the needle. The piston is displaced in the axial direction according to the extension or contraction of the actuator. The outer sleeve holds the piston slidably on an outer circumferential side of the piston and defines a pressure chamber of high-pressure fuel. The pressure chamber is expanded or shrunk according to the displacement of the piston. Fuel pressure in the pressure chamber is applied to the needle in a valve opening direction in which the needle opens the nozzle hole. The fuel pressure in the pressure chamber is increased upon the extension of the actuator, so that the needle opens the nozzle hole and thereby high-pressure fuel is injected through the nozzle hole. The inner sleeve is slidably fitted around an outer circumferential side of the needle and is received in the pressure chamber. The urging means is for urging the inner sleeve in the axial direction, and is for increasing or decreasing urging force of the urging means applied to the inner sleeve according to the displacement of the piston. The inner sleeve urged by the urging means annularly engages or disengages from the engagement surface. High-pressure fuel is supplied into the fuel chamber by the fuel supply source. A gap between the fuel chamber and the pressure chamber is closed or opened when the inner sleeve engages or disengages from the engagement surface, respectively.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

An injector according to a first embodiment of the invention includes a needle, an actuator, a piston, and an outer sleeve. The needle opens or closes a nozzle hole. The actuator extends or contracts in an axial direction of the injector. The piston is displaced in the axial direction according to the extension or contraction of the actuator. The outer sleeve slidably holds the piston on its outer circumferential side, and defines a pressure chamber of fuel, which is expanded or contracted according to the displacement of the piston. The needle is incorporated into the injector such that fuel pressure in the pressure chamber is applied to the needle in the valve opening direction. The injector injects high-pressure fuel by increasing fuel pressure in the pressure chamber upon the extension of the actuator to make the needle open the nozzle hole.

The injector includes an inner sleeve, an urging means, and a fuel chamber. The inner sleeve is fitted slidably on an outer circumferential side of the needle and is received in the pressure chamber. The urging means urges the inner sleeve in the axial direction, and increases or decreases its urging force applied to the inner sleeve according to the displacement of the piston. High-pressure fuel is supplied into the fuel chamber, and a gap between the fuel chamber and the pressure chamber is closed or opened when the inner sleeve urged by the urging means annularly engages or disengages from a predetermined engagement surface.

The injector further includes a body, which slidably holds the needle in the axial direction and defines a nozzle chamber on a front end side of the needle. High-pressure fuel is led into the nozzle chamber, and then injected through the nozzle hole. High-pressure fuel is supplied from the nozzle chamber into the fuel chamber through a fuel flow passage, which is formed between an outer circumferential surface of the needle and the inner circumferential surface of the body.

An injector according to a second embodiment of the invention includes a body having an engagement surface. An outer circumferential side of an outer sleeve is filled with high-pressure fuel. High-pressure fuel is supplied into a fuel chamber from the outer circumferential side of the outer sleeve through fuel flow passages formed in the outer sleeve and the body.

First Embodiment

Figure 1A:
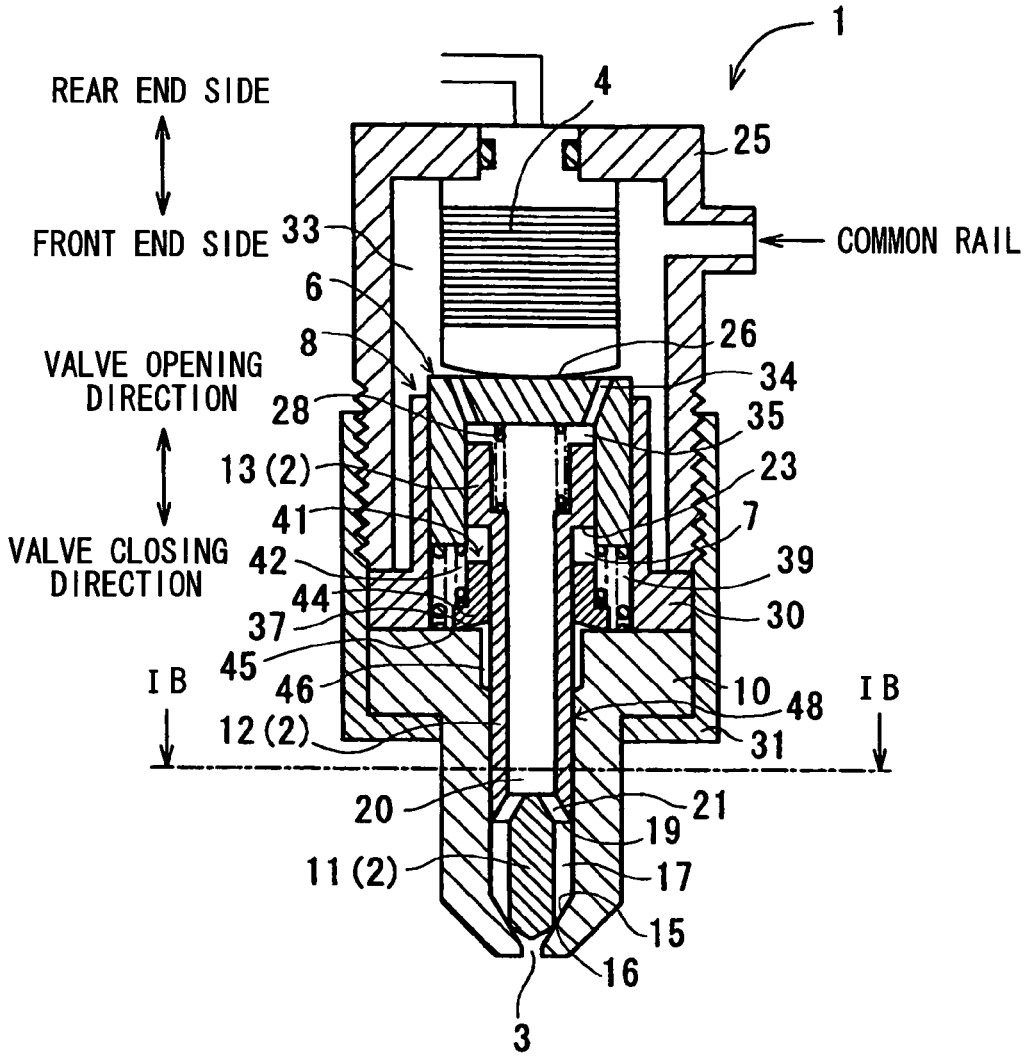
FIG. 1A is a schematic view illustrating a configuration of an injector according to a first embodiment of the invention.
Figure 1B:
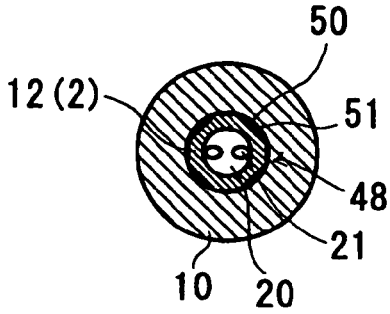
FIG. 1B is a cross-sectional view taken along a line IB-IB in FIG. 1A.

A configuration of an injector 1 according to the first embodiment is described with reference to FIGS. 1A, 1B. The injector 1 is installed in a direct fuel-injection engine (not shown) such as a diesel engine, and injects and supplies high-pressure fuel received from a common rail directly into a cylinder. The injector 1 injects fuel by driving a needle 2 to be lifted up in order to open a nozzle hole 3. A piezoelectric element, which is extended by the application of voltage, constitutes an actuator 4 of the injector 1, and extending force of the piezoelectric element is used as driving force for the needle 2.

The injector 1 includes the needle 2, the actuator 4, a piston 6, and an outer sleeve 8. The needle 2 opens or closes the nozzle hole 3. The actuator 4 is extended or contracted in an axial direction. The piston 6 is displaced in the axial direction according to the extension or contraction of the actuator 4. The outer sleeve 8 slidably supports the piston 6 on its outer circumferential side, and defines a pressure chamber 7 of fuel. The pressure chamber 7 is expanded or contracted according to the displacement of the piston 6.

The needle 2 includes a front end portion 11, an axial portion 12, and a rear end portion 13. The front end portion 11 engages or disengages from a front end side body 10 to close or open the nozzle hole 3, respectively. The axial portion 12 is slidably held by the front end side body 10. The rear end portion 13 is slidably held by the piston 6.

The front end portion 11 has a seat portion 16, which engages a seat surface 15 formed in a conical shape on an inner circumferential side of the front end side body 10. The nozzle hole 3 is formed at a front end of the seat surface 15, and is closed or opened when the seat portion 16 engages or disengages from the seat surface 15. A nozzle chamber 17 is formed between an outer circumferential surface of the front end portion 11 and an inner circumferential surface of the front end side body 10. Fuel that has flowed into the nozzle chamber 17 is injected through the nozzle hole 3. Fuel pressure in the nozzle chamber 17 is applied to the needle 2 in a valve opening direction.

The axial portion 12 has a larger diameter than that of the front end portion 11. An annular step surface 19 is formed on a front end side of the axial portion 12 to define a division between the front end portion 11 and the axial portion 12. The axial portion 12 is formed in a cylindrical shape to have a hollow space therein. The hollow space serves as a fuel flow passage 20, which leads high-pressure fuel received from the common rail into the nozzle chamber 17. A fuel flow passage 21, which opens on the step surface 19, communicates between the nozzle chamber 17 and the fuel flow passage 20.

The rear end portion 13 has a larger diameter than that of the axial portion 12. An annular step surface 23 is formed on a front end side of the rear end portion 13 to define a division between the axial portion 12 and the rear end portion 13. The rear end portion 13 has a hollow space, which is coaxial with the fuel flow passage 20. The hollow space opens on a rear end surface of the rear end portion 13, and constitutes the fuel flow passage 20.

A rear end portion of the actuator 4 is attached and fixed to a rear end side body 25, and a front end portion of the actuator 4 is in contact with a rear end surface 26 of the piston 6. Accordingly, the actuator 4 generates extending force toward the front end side upon the application of voltage, and the piston 6 is urged toward the front end side by the extending force.

The piston 6 is formed in a cylindrical shape, which opens widely on the front end side. The piston 6 slidably holds the rear end portion 13 of the needle 2 on its inner circumferential side. The piston 6 is in contact with the front end portion of the actuator 4, and is displaced according to the extension or contraction of the actuator 4. A spring 28 is disposed between the piston 6 and the rear end portion 13 to urge the needle 2 in a valve closing direction.

The outer sleeve 8 has a front end portion 30 formed in a flange shape. The front end portion 30 is held between the front end side body 10 and the rear end side body 25. More specifically, a male thread is formed on an outer circumferential side of a front end portion of the rear end side body 25. The outer sleeve 8, the front end side body 10, and the rear end side body 25 are firmly integrated by screwing up a female thread of a sleeve nut 31 on the male thread of the rear end side body 25 with the front end portion 30 held between the front end side body 10 and the rear end side body 25.

An outer circumferential surface of the outer sleeve 8, an inner circumferential surface of the rear end side body 25, the rear end surface 26 of the piston 6 define a high-pressure chamber 33, which is filled with high-pressure fuel received from the common rail. The high-pressure chamber 33 and a fuel chamber 35 communicate through a fuel flow passage 34 formed in the piston 6. The fuel chamber 35 is defined by the piston 6 and the rear end portion 13 of the needle 2, and connected to a rear end side of the fuel flow passage 20. Accordingly, fuel in the high-pressure chamber 33 is supplied to the nozzle chamber 17 through the fuel flow passage 34, the fuel chamber 35, the fuel flow passage 20, and the fuel flow passage 21 in this order. The actuator 4 is received in the high-pressure chamber 33 to be in contact with the rear end surface 26 of the piston 6.

An inner circumferential surface of a front end side of the outer sleeve 8, a front end surface of the piston 6, the step surface 23, and a rear end surface 37 of the front end side body 10 define the pressure chamber 7. Fuel pressure in the pressure chamber 7 is applied to the step surface 23 in a direction toward the rear end side, and is accordingly applied to the needle 2 in the valve opening direction. In other words, the needle 2 is incorporated into the injector 1 such that fuel pressure in the pressure chamber 7 is applied to the needle 2 in the valve opening direction. Consequently, when the piston 6 is displaced toward the front end side upon the extension of the actuator 4, fuel pressure in the pressure chamber 7 is increased. Thus, urging force applied to the needle 2 in the valve opening direction is increased, so that the needle 2 is driven to lift off. As a result, the nozzle hole 3 is opened to inject fuel.

The pressure chamber 7 receives a spring 39, which is held in the axial direction by the front end side body 10 and the piston 6 and urges the piston 6 toward the rear end side. When the length of the actuator 4 returns to its initial length, the piston 6 is urged by the spring 39 to be displaced toward the rear end side and thereby fuel pressure in the pressure chamber 7 is decreased. Accordingly, the urging force applied to the needle 2 in the valve opening direction is decreased, and the needle 2 is urged by the spring 28 to be displaced toward the front end side to close the nozzle hole 3.

The injector 1 further includes an inner sleeve 41 and a spring 42. The inner sleeve 41 is fitted slidably on an outer circumferential side of the axial portion 12 and is received in the pressure chamber 7. The spring 42 is received in the pressure chamber 7 and urges the inner sleeve 41 toward the front end side in the axial direction.

The inner sleeve 41 has a front end portion 44 having a flanged shape. The spring 42 is held between the front end portion 44 of the inner sleeve 41 and the piston 6. Thus, urging force of the spring 42 applied to the inner sleeve 41 is increased or decreased according to the displacement of the piston 6. An outer circumferential edge 45 of the front end portion 44 is formed in an acute-angled shape such that it projects toward the front end side along its whole circumference. The outer circumferential edge 45 annularly engages the rear end surface 37 of the front end side body 10 due to urging force of the spring 42. A region inward of an engagement position of the outer circumferential edge 45 with the rear end surface 37 serves as a fuel chamber 46, which is liquid-tightly separated from the pressure chamber 7 located outward of the engagement position.

The fuel chamber 46 is formed to have predetermined volume from the rear end surface 37 toward the front end side. More specifically, a guide hole 48 for holding the axial portion 12 has a larger diameter than the axial portion 12 in a predetermined range from the rear end surface 37 toward the front end side. Accordingly, the volume that defines the fuel chamber 46 is ensured between an inner circumferential surface of the guide hole 48 and an outer circumferential surface of the axial portion 12.

High-pressure fuel is supplied from the nozzle chamber 17 into the fuel chamber 46 through a fuel flow passage 50, which is formed between an outer circumferential surface of the needle 2 and the inner circumferential surface of the front end side body 10. More specifically, the fuel chamber 46 communicates with the nozzle chamber 17 through the fuel flow passage 50, and high-pressure fuel, which has flowed into the nozzle chamber 17 from the high-pressure chamber 33, is supplied into the fuel chamber 46 through the fuel flow passage 50. The fuel flow passage 50 is formed between a plane surface 51 formed on the outer circumferential side of the axial portion 12 and the inner circumferential surface defining the guide hole 48.

Workings of the injector 1 of the first embodiment are described below. When the fuel pressure in the pressure chamber 7 is increased upon the application of voltage to the actuator 4, the needle 2 is driven to lift off to inject fuel. Meanwhile, fuel in the pressure chamber 7 leaks from sliding portions due to the increase in its pressure. The outer circumferential edge 45 of the inner sleeve 41 firmly engages the rear end surface 37 to liquid-tightly separate the pressure chamber 7 from the fuel chamber 46.

When the application of voltage to the actuator 4 is stopped so that the fuel pressure in the pressure chamber 7 is decreased, the needle 2 is displaced toward the front end side to close the nozzle hole 3. Meanwhile, an amount of fuel decreased due to the leak is supplied into the pressure chamber 7 from the fuel chamber 46. More specifically, when the fuel pressure in the pressure chamber 7 is decreased and the piston 6 is displaced toward the rear end side, the urging force of the spring 42 applied to the inner sleeve 41 is made small. As a result, the inner sleeve 41 is urged toward the rear end side by fuel pressure in the fuel chamber 46 to disengage from the rear end surface 37, thereby opening a gap between the fuel chamber 46 and the pressure chamber 7. Accordingly, high-pressure fuel in the fuel chamber 46 flows into the pressure chamber 7, so that the amount of fuel decreased due to the leak is replenished.

The injector 1 of the first embodiment injects high-pressure fuel by increasing the fuel pressure in the pressure chamber 7 upon the extension of the actuator 4 to make the needle 2 open the nozzle hole 3. The injector 1 includes the inner sleeve 41 and the spring 42. The inner sleeve 41 is fitted slidably on the outer circumferential side of the needle 2 and is received in the pressure chamber 7. The spring 42 urges the inner sleeve 41 in the axial direction, and increases or decreases its urging force applied to the inner sleeve 41 according to the displacement of the piston 6. When the inner sleeve 41 urged by the spring 42 annularly engages the rear end surface 37, the fuel chamber 46, which is liquid-tightly separated from the pressure chamber 7, is formed. High-pressure fuel is supplied into the fuel chamber 46 through the fuel flow passage 50 from the nozzle chamber 17.

When the extension of the actuator 4 is stopped, the length of the actuator 4 returns to its initial length and the piston 6 is displaced toward the rear end side. Meanwhile, the urging force of the spring 42 applied to the inner sleeve 41 is made small, so that the inner sleeve 41 disengages from the rear end surface 37 and thereby high-pressure fuel is replenished into the pressure chamber 7 from the fuel chamber 46. Since the inner sleeve 41 is formed to have a small diameter to such an extent that the inner sleeve 41 is received in the pressure chamber 7, the inner sleeve 41 engages or disengages from the rear end surface 37 annularly at the position not far away from the shaft center of the injector 1. Consequently, an engagement diameter of the inner sleeve 41 is made small, so that the liquid-tightness of the pressure chamber 7 is easily ensured.

Second Embodiment

Figure 2:
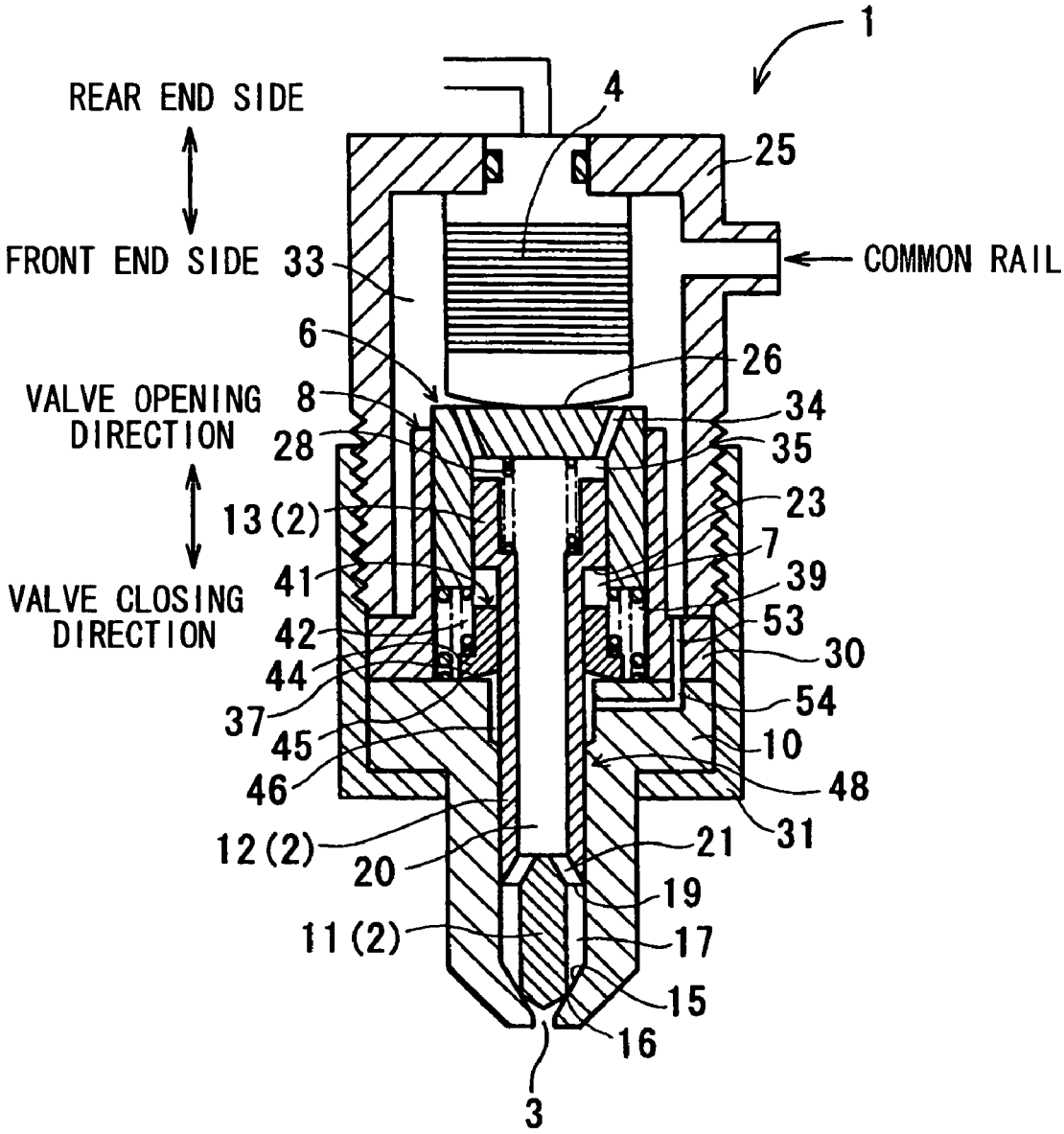
FIG. 2 is a schematic view illustrating a configuration of an injector according to a second embodiment of the invention.
Figure 3:
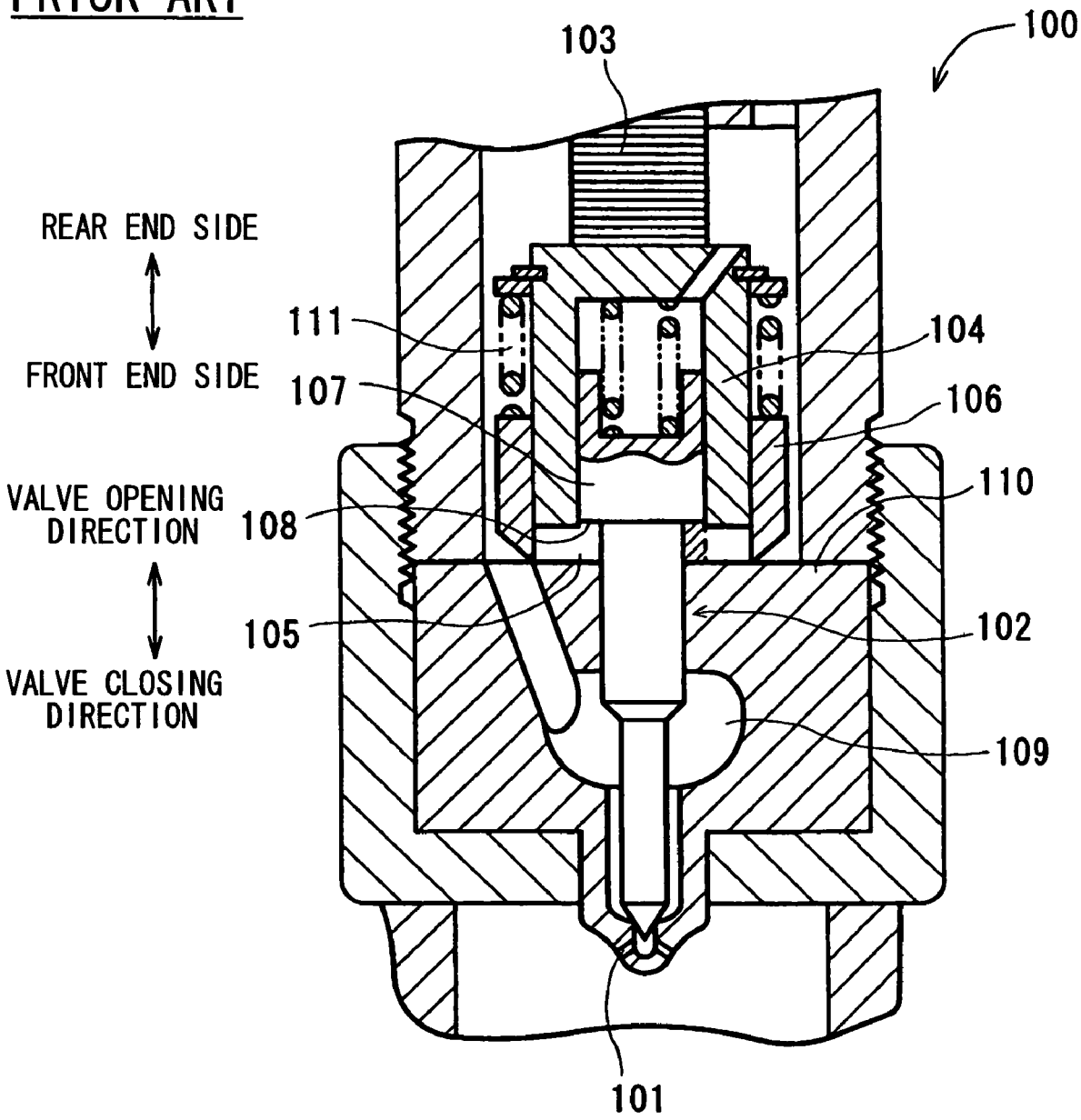
FIG. 3 PRIOR ART
FIG. 3 is a schematic view illustrating a configuration of a previously proposed injector.

As shown in FIG. 2, in an injector 1 according to the second embodiment, high-pressure fuel is supplied into a fuel chamber 46 directly from a high-pressure chamber 33 through a fuel flow passage 53 formed in a front end portion 30 of an outer sleeve 8 and a fuel flow passage 54 formed in a front end side body 10.

MODIFICATION

According to the injector 1 of the first and second embodiments, the actuator 4 includes the piezoelectric element. Alternatively, a magnetostrictor, which extends upon generation of a magnetic field, may be used in the actuator 4.

Additional advantages and modifications will readily occur to those skilled in the art. The invention in its broader terms is therefore not limited to the specific details, representative apparatus, and illustrative examples shown and described.

What is claimed is:

1. An injector for injecting high-pressure fuel supplied by a fuel supply source, the injector comprising:

a nozzle hole through which high-pressure fuel is injected;

a needle that opens or closes the nozzle hole;

an actuator that extends or contracts in an axial direction of the needle;

a piston that is displaced in the axial direction according to the extension or contraction of the actuator;

an outer sleeve holding the piston slidably on an outer circumferential side of the piston and defining a pressure chamber of high-pressure fuel, wherein:

the pressure chamber is expanded or shrunk according to the displacement of the piston;

fuel pressure in the pressure chamber is applied to the needle in a valve opening direction in which the needle opens the nozzle hole; and the fuel pressure in the pressure chamber is increased upon the extension of the actuator, so that the needle opens the nozzle hole and thereby high-pressure fuel is injected through the nozzle hole;

an inner sleeve slidably fitted around an outer circumferential side of the needle and received in the pressure chamber;

an urging means for urging the inner sleeve in the axial direction, and for increasing or decreasing urging force of the urging means applied to the inner sleeve according to the displacement of the piston;

an engagement surface, which the inner sleeve urged by the urging means annularly engages or disengages from; and a fuel chamber into which high-pressure fuel is supplied by the fuel supply source, wherein a gap between the fuel chamber and the pressure chamber is closed or opened when the inner sleeve engages or disengages from the engagement surface, respectively.

2. The injector according to claim 1, further comprising a body that slidably holds the needle in the axial direction and that defines a nozzle chamber on a front end side of the needle, wherein:

high-pressure fuel is led into the nozzle chamber to be injected through the nozzle hole; and high-pressure fuel is supplied to the fuel chamber from the nozzle chamber through a fuel flow passage formed between an outer circumferential surface of the needle and an inner circumferential surface of the body.

3. The injector according to claim 1, further comprising a body having the engagement surface, wherein:

an outer circumferential side of the outer sleeve is filled with high-pressure fuel; and high-pressure fuel is supplied to the fuel chamber from the outer circumferential side of the outer sleeve through a fuel flow passage formed in the outer sleeve and the body.

* * * * *